United States Patent [19]

Huff

[11] 4,149,330

[45] Apr. 17, 1979

[54] DIGITAL INSTANT SCHEDULE COMPUTER

[76] Inventor: Gerald B. Huff, 340 Milledge Cir., Athens, Ga. 30606

[21] Appl. No.: 788,251

[22] Filed: Apr. 18, 1977

[51] Int. Cl.[2] ..... G09F 11/00

[52] U.S. Cl. ..... 40/491; 40/375; 116/321; 235/70 A; 273/29 R

[58] Field of Search ..... 40/65, 109, 110, 375, 40/491; 283/49, 50; 116/120, 135; 273/148 R, 148 A, 29 R, 29 A; 235/70 R, 70 A, 70 B, 70 C, 84

[56] References Cited

U.S. PATENT DOCUMENTS

| | | | |
|---|---|---|---|
| 2,171,873 | 9/1939 | Gould | 40/65 X |
| 3,113,779 | 12/1963 | Guenther | 116/120 |
| 3,777,699 | 12/1973 | Pfleger | 273/148 R X |

*Primary Examiner*—John F. Pitrelli
*Assistant Examiner*—G. Lee Skillington

[57] ABSTRACT

The present invention, a digital instant schedule computer or DISC, computes and displays symmetric schedules for assigning to stations the participants in an experiment or tournament. There is a master board and a plurality of slides, each of which can be inserted in said master board in several ways. Each insertion of a slide gives a juxtaposition of two scales: a scale on the slide which gives the indicia of the participants to be scheduled and a scale on the master board which gives indicia referring to the stations. Each admissible setting of a slide in the master board gives a subschedule which assigns each participant to the station opposite his indicium. The participant indicia and station indicia are displayed so that each participant can read off his station assignment.

4 Claims, 8 Drawing Figures

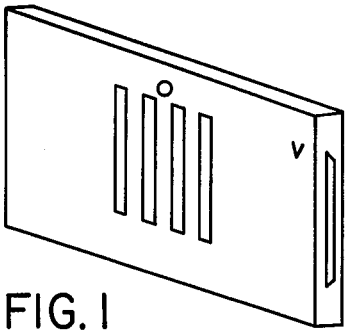
FIG. 1
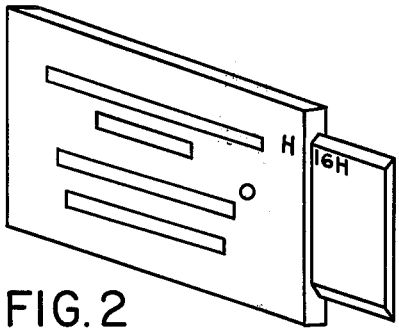
FIG. 2
FIG. 3
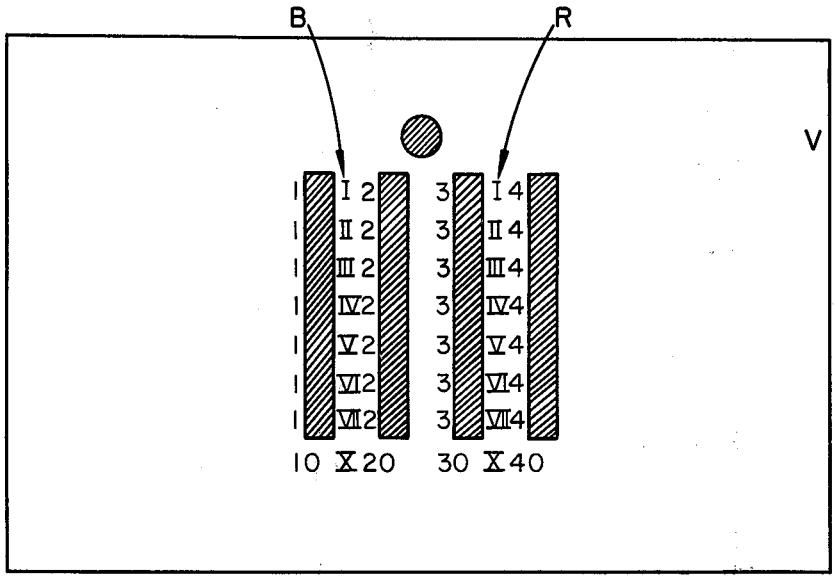
FIG. 4
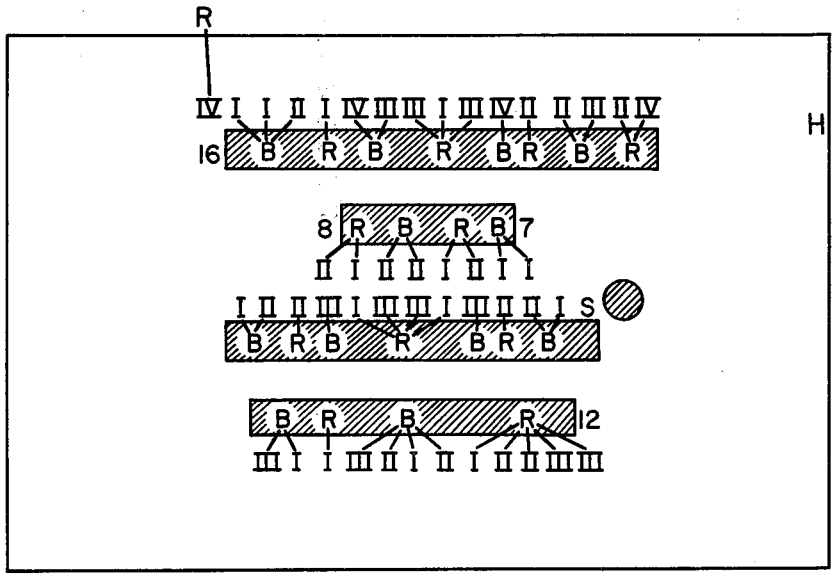

DIGITAL INSTANT SCHEDULE COMPUTER

BACKGROUND OF THE INVENTION

1. Field of the invention

The present invention is a special purpose digital slide rule which uses graphical addition to carry out addition in a modular arithmetic and thus to compute and display symmetric schedules.

Symmetric schedules are used in planning agricultural experiments for optimal statistical inference, in calibration designs for comparing pairs of objects, and in tournaments which match pairs against pairs. For the sake of clarity and to demonstrate usefulness, the preferred embodiment pictured in the drawings and described below is a digital instant schedule computer best suited to schedule a variety of round robin tennis tournaments.

2. Description of the prior art

A court manager at a tennis club often wants a symmetric schedule to keep the courts full with doubles games in prime time and let all members present play equally and with a good variety of court companions. Many such schedules exist and may be purchased in a variety of forms. Even after he has provided himself with a schedule, either by purchase or by trial and error, the court manager still needs an effective way of informing the players of their court assignments round by round. Many a tournament committee has spent an evening preparing elaborate charts to solve the communications problem, only to have the charts made obsolete by a shortage or surplus of players when play is to begin.

The court manager needs (i) to be able to produce a symmetric schedule, (ii) to do this on short notice, and (iii) to communicate this schedule quickly and clearly to the players.

Types of well-known symmetric schedules

In a mixer schedule, the players change partners in each round and no player encounters any other player more than once. (Schwed, "Unraveling round robin madness", WORLD TENNIS 22 (1975) No. 12, May, 40–42).

In a balanced schedule, the players change partners in each round. Each player has each other player as partner exactly once and as opponent exactly twice. (Scheid, "A tournament problem", Amer. Math. Monthly 67 (1960) 39–41).

In a spouse-avoiding schedule for mixed doubles, ladies and gentlemen enter as couples. The players change partners each round. Each player opposes each other player of the same sex exactly once and has each player of the opposite sex, except spouse, as partner exactly once and as opponent exactly once. No player is scheduled on the same court with spouse. (Brayton, Coppersmith, and Hoffman, "Self-orthogonal latin squares", Bull. Amer. Math. Soc. 80 (1974), 116–118).

In a favorite partner round robin schedule, each pair plays as a team throughout the schedule and meets each other pair exactly once.

Many court managers use the booklet by Eleanor B. Owens published by the United States Tennis Association (TENNIS EASY ON - EASY OFF, 71 University Place, Princeton, N.J. 08540, 1975). This latter booklet gives many partially symmetric schedules and sound directions for organizing and scoring tournaments.

Many of the more complex schedules, made up by trial and error, are imperfect, and the communication problem is difficult.

The mathematical theory of symmetric schedules

Although balanced schedules for bridge tournaments were given by Saffold in the first volume of WHIST in 1893, the mathematical theory was probably initiated by E. H. Moore ("Tactical memoranda", Amer. J. Math. 18 (1898) 263–303). A reasonably complete solution of the "tournament" problem was given a dozen years ago by R. C. Bose and J. M. Cameron ("The bridge tournament problem and calibration designs for comparing pairs of objects", J. Res. Nat. Bur. Standards, 69B, (1965) 323–332).

In this theory, numbers in a modular arithmetic are assigned to the participants and station assignments are made for an initial round satisfying the condition of "symmetrically repeated differences". Each later round is then computed by adding some number in this modular arithmetic to each number in the initial schedule. Effective as this may be for a mathematician versed in the art, it is of no use to a court manager or tournament committee.

The digital instant schedule computer to be described below uses this theory to compute and display a variety of popular symmetric schedules and can be used by a person with no knowledge of slide rules, the basic theory, or of modular arithmetic.

The present inventor knows of no other use of a digital slide rule to compute symmetric schedules nor to display them.

SUMMARY OF THE INVENTION

Accordingly, it is the object of this invention to provide a digital slide rule which can be used by a person with no knowledge of the mathematical theory to compute a wide variety of symmetric schedules which can be computed from an initial subschedule by addition in a modular arithmetic.

It is another object of this invention to provide a digital slide rule which employs graphical addition to perform the required addition in a modular arithmetic very quickly.

It is still another object of this invention to provide a slide rule which displays each subschedule as it is computed so that each participant can read off his station assignment.

Briefly, these and other objects have been achieved by designing a master board with two faces in which a plurality of slides can be inserted in different ways.

BRIEF DESCRIPTION OF THE DRAWINGS

A more complete appreciation of the invention and many of its advantages may be readily obtained as the DISC becomes better understood by reference to the following description in connection with the accompanying drawings, wherein:

FIG. 1 shows the master board with the V-face forward and the slot open.

FIG. 2 shows the master board with the H-face forward and a slide inserted in the slot.

FIG. 3 shows the details of the V-face of the master board. The hatched areas are viewing means. The arabic participant indicia are all black in a working model and the station indicia are blue or red. A vertical column of blue station indicia is indicated by an arrow from B and a vertical column of red station indicia is indicated by an arrow from R.

FIG. 4 shows the details of the H-face of the master board. The hatched areas are viewing means. The arabic participant indicia are black on a working model and the station indicium are blue or red. Each blue station indicia is indicated by an arrow from B and each red station indicia is indicated by an arrow from R.

Figure 5:
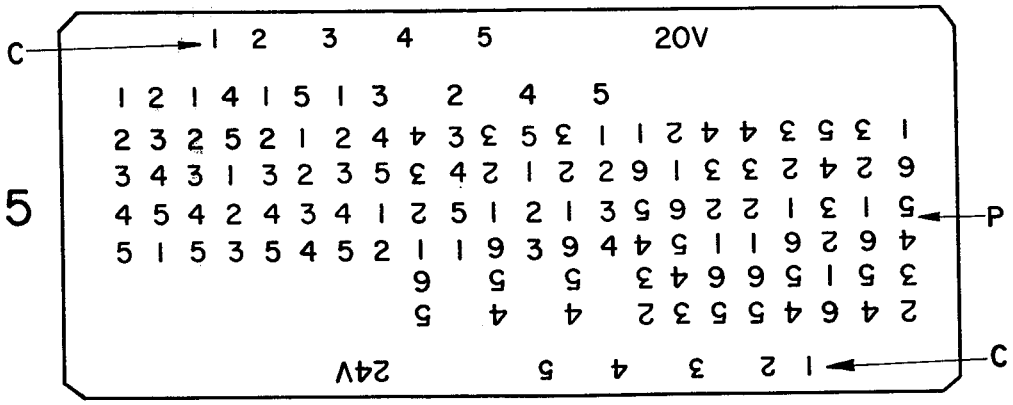
FIG. 5 gives the V-side of slide 1.
Figure 6:
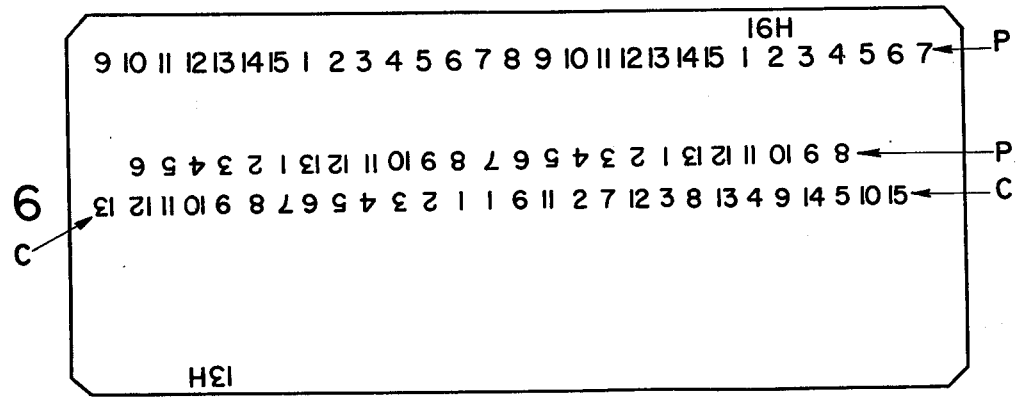
FIG. 6 gives the H-side of slide 1.
Figure 7:
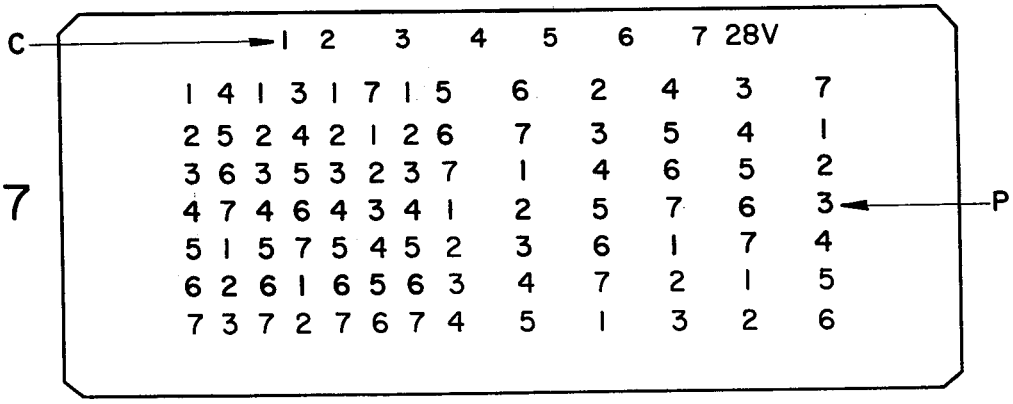
FIG. 7 gives the V-side of slide 2.
Figure 8:
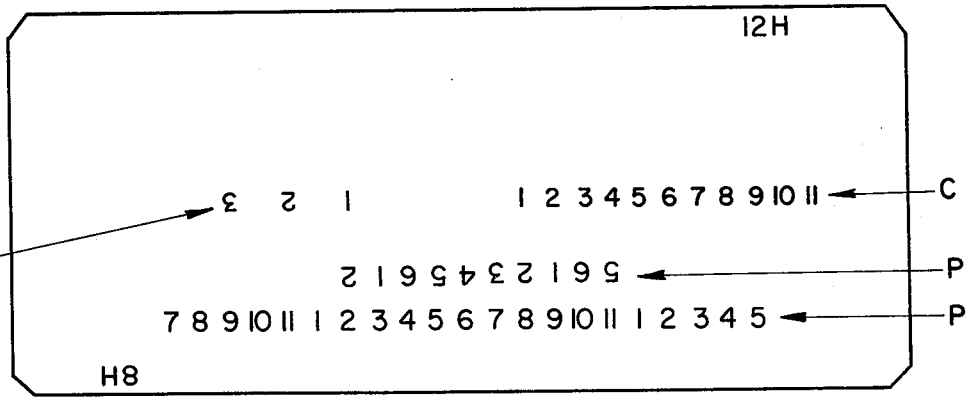
FIG. 8 gives the H-side of slide 2.

In each of FIGS. 5, 6, 7, and 8, a scale of participant indicia in indicated by an arrow from P and a scale of control indicia is indicated by an arrow from C.

DESCRIPTION OF THE DIGITAL INSTANT SCHEDULE COMPUTER

There is a master board which has two faces and a central slot in which each one of two slides can be inserted. The V-face of the master board has four vertical rectangular viewing means and a circular viewing means. Court stations are indicated on this face by red and blue station indicia. The H-face of the master board has four horizontal rectangular viewing means and a circular viewing means. Court positions are indicated on this face by red and blue station indicia.

There are two rectangular slides which can be inserted in the slot in the master board. Each rectangular slide has two sides - a V-side and a H-side. When the V-face of the master board is forward, as in FIG. 1, a slide must be inserted with its V-side forward. When the H-face of the master board is forward, as in FIG 2, a slide must be inserted with its H-side forward.

Procedure with the V-face of the master board forward

Slide 1 may be inserted in the slot with the V-side forward in two ways: with 20V in the upper right or with 24V in the upper right. Slide 2 may be inserted in the slot with the V-side forward in only one way - with 28V in the upper right.

Procedure with the H-face of the master board forward

Slide 1 may be inserted in the slot in two ways: with 16H in the upper right or with 13H in the upper right. Slide 2 may be inserted in the slot in two ways: with 12H in the upper right or with 8H in the upper right.

Admissible settings of a slide in the master board

A slide may be set in the master board in a discrete number of admissible settings. A scale of control indicia is placed on each slide so that exactly one control indicium is visible in a circular viewing means in the face of the master board for each admissible setting and no control indicium is visible otherwise. Movement of the slide from the initial admissible setting to any new admissible setting computes the new subschedule by graphical addition.

Manufacture of the DISC

The faces of the master board and the slide are to be made of a rigid, washable plastic; e.g. one-eighth inch polystyrene. The master board might be fourteen inches by twenty-two inches, with the slides ten inches by twenty-four inches. The numerals and characters must be at least three-fourth inches high and legible at a distance of ten yards.

The central slot in the master board and the slides are to be constructed so that a slide can be inserted in the slot only with its V-side toward the V-face of the master board and with its H-face toward the H-face of the master board. The horizontal rectangular viewing means in the H-face of the master board and the several scales of participant indicia on the H-faces of the slides are placed so that exactly one scale of participant indicia is visible in a horizontal viewing means for each insertion of a slide in the slot in the master board.

Use of the DISC to schedule a tournament

The court manager will be provided with a booklet which, among other things, lists the symmetric schedules which can be most readily computed by this DISC. For each such schedule, the directions tell how the participants are to be named with arabic indicia, how the court stations are to be indicated with red and blue station indicia, and how the appropriate slide must be inserted in the master board.

Experience has shown that this DISC can be used very effectively with two sets of station markers. One set has the red Roman numerals I, II, III, IV, V, VI, VII, and X and the other set has the blue Roman numerals I, II, III, IV, V, VI, VII, and X. When it has been decided how the stations are to be indicated by blue and red station indicia, these can be placed on the courts in the proper positions to help the participants to find their stations quickly. The station markers are absolutely necessary in administering schedules like those in EXAMPLES 4, 5, and 8 given below.

Once the number of participants is known and the type of symmetric schedule to be played has been determined, the prescribed participant indicia are assigned to the players and the designation of the court stations by red or blue station indicia is explained orally or by placing the station markers in the prescribed positions. The prescribed slide is inserted as recommended in the master board and the slide is set so that the initial control indicium appears in the circular viewing means. The only instruction to the participants is: "Read the station assignment opposite your name and report to that station. You will meet your partner and opponents there". After each subschedule has been played, the DISC is set so that the control indicium of the next subschedule shows in the circular viewing means and play proceeds as before. It is true that some participants learn to read off the numbers of their partners and opponents after playing a few subschedules of a DISC schedule, but this is not necessary for the tournament to run quickly and smoothly.

The invention having been generally described, a more complete understanding of its usefulness can be obtained by reference to the following examples, which are included for the purpose of illustration only and are not intended to be limiting.

EXAMPLE 1

A mixer for twenty-eight participants on seven courts in seven rounds

With the V-face of the master board forward, slide 2 is inserted in the slot with the V-side forward and 28V in the upper right. The 28 participants are named 11, 12, 13, 14, 15, 16, 17; 21, 22, 23, 24, 25, 26, 27; 31, 32, 33, 34, 35, 36, 37; 41, 42, 43, 44, 45, 46, and 47. The courts are numbered I, II, III, IV, V, VI, and VII. The station on the north side of a court is designated by the corresponding blue Roman numeral and the station on the south side of a court is designated by the corresponding red Roman numeral; e.g. a red III refers to the south side of court III and a blue V refers to the north side of court V. A subschedule is displayed when one of the control indicia 1, 2, 3, 4, 5, 6, or 7 appears in the circular viewing means.

Mixer schedules for 24 participants on six courts or for 20 participants on five courts are computed and displayed similarly. With the V-face of the master board forward, slide 1 is inserted with the V-side forward and 24V or 20V in the upper right, respectively.

EXAMPLE 2

A mixer for sixteen participants on four courts in five rounds

With the H-face of the master board forward, slide 1 is inserted in the slot with the H-side forward and 16H in the upper right. The participants are named 1, 2, 3, 4, 5, 6, 7, 8, 9, 10, 11, 12, 13, 14 15, and 16. The courts are numbered I, II, III, and IV. The station on the north side of a court is indicated by the corresponding blue Roman numeral and the station on the south side of a court is indicated by the corresponding red Roman numeral. A subschedule is given when one of the control indicia 1, 2, 3, 4, or 5 appears in the circular viewing means.

In this beautifully symmetric schedule, each participant meets each other participant exactly once.

EXAMPLE 3

A balanced schedule for sixteen participants on 4 courts in 15 rounds

With the H-face of the master board forward, slide 1 is inserted in the slot with the H-side forward and 16H in the upper right. The sixteen participants are named 1, 2, 3, 4, 5, 6, 7, 8, 9, 10, 11, 12, 13, 14, 15, and 16. The courts are numbered I, II, III, and IV. The station on the north side of a court is indicated by the corresponding blue Roman numeral and the station on the south side of a court is indicated by the corresponding red Roman numeral. A subschedule is given when one of the control indicia 1, 2, 3, 4, 5, 6, 7, 8, 9, 10, 11, 12, 13, 14 or 15 appears in the circular viewing means.

A balanced schedule for thirteen participants on three courts or for twelve participants on three courts is computed and displayed similarly by using slide 1 with the H-side forward and 13H in the upper right or by using slide 2 with the H-side forward and 12H in the upper right, respectively.

EXAMPLE 4

A balanced schedule for eight participants on 2 courts in 7 rounds

With the V-face of the master board forward, slide 1 is inserted in the slot with the V-side forward and 28V in the upper right. The participants are named 10, 11, 12, 13, 14, 15, 16, and 17. On one court, the stations on the north side are designated by a blue I and a blue V; and the station on the south side are designated by a blue II and a blue III. On the other court, the stations on the north side are designated by a blue IV and a blue VI; and the stations on the south side are designated by a blue VII and a blue X. A subschedule is given when one of the control indicia 1, 2, 3, 4, 5, 6, or 7 appears in the circular viewing means.

This example illustrates a schedule which requires the use of station markers to help the players find their stations easily.

EXAMPLE 5

A spouse-avoiding schedule for 7 couples on 3 courts in 7 rounds

With the V-face of the master board forward, slide 2 is inserted in the slot with the V-side forward and 28V in the upper right, the couples are named (13,22), (12,26), (16,24), (14, 25), (15,21), (11,23), (17,27) where the men have numbers in the teens and the ladies have numbers in the twenties. The opposite sides of the three courts are designated by the blue Roman numerals I and VI; II and V; and III and IV. In any round the two participants assigned to the blue VII sit out the round. A subschedule is given when one of the control indicia 1, 2, 3, 4, 5, 6, or 7 appears in the circular viewing means.

This also illustrates the use of a different disposition of the station markers to produce a different schedule.

A spouse-avoiding schedule for five couples on two courts can be produced similarly by inserting slide 1 with the V-side forward and 20V in the upper right and making the recommended disposition of the station markers.

EXAMPLE 6

A spouse-avoiding schedule for 4 couples on 2 courts in 3 rounds

With the H-face of the master board forward, slide 2 is inserted in the slot with 8H in the upper right. The couples are assigned the participant indicia (1, 2), (3, 4), (5, 6), and (7, 8). The men have the participant indicia 1, 3, 5, and 7 and the ladies have the participant indicia 2, 4, 6, and 8. The courts are designated by I and II. The station on the north side of a court is designated by the corresponding blue Roman numeral and the station on the south side of a court is designated by the corresponding red Roman numeral. A subschedule is given when one of the control indicia 1, 2, or 3 appears in the circular viewing means.

EXAMPLE 7

A favorite partner round robin for thirteen couples on six courts in thirteen rounds With the H-face of the master board forward, slide 1 is inserted in the slot with the H-side forward and 13H in the upper right. The pairs are named 1, 2, 3, 4, 5, 6, 7, 8, 9, 10, 11, 12, and 13. Three courts are numbered with the red Roman numerals I, II, and III; and the other three courts are numbered with the blue Roman numerals I, II, and III. The pair assigned to S in any round sits out that round. A subschedule is given when one of the control indicia 1, 2, 3, 4, 5, 6, 7, 8, 9, 10, 11 12, or 13 appears in the circular viewing means.

If a seventh court is available, this same schedule can be used for fourteen couples; the fourteenth couple is assigned permanently to the seventh court and the team assigned to S plays the fourteenth team on that court.

Insertions of slides with the H-side forward give similar favorite partner schedules for 11, 12, 15, and 16 pairs.

EXAMPLE 8

A favorite partner schedule for eight couples on four courts in seven rounds.

With the V-face of the master board forward, slide 2 is inserted in the slot with the V-side forward and 28V in the upper right. The teams are named 10, 11, 12, 13, 14, 15, 16, and 17. The opposite sides of the four courts are designated by the blue Roman numerals I and VI; II and V; III and IV; and finally VII and X. A subschedule is given when one of the control indicia 1, 2, 3, 4, 5, 6, or 7 appears in the circular viewing means.

These examples illustrate the usefulness of the invention for computing and displaying a great variety of popular symmetric schedules. With the DISC at courtside and the type of schedule to be played determined, the court manager need only count the number of players present, consult his book of instructions, insert the prescribed slide correctly in the master board, set the slide to give the initial subschedule and play can begin immediately. The computation of the later subschedules is almost instantaneous. The fact that the DISC displays each subschedule so that each participant can read his court assignment quickly speeds up the play.

EXAMPLES 1, 4, 5, and 8 were included in this short list of examples to show how apparently different schedules may be obtained from the DISC by changing the meaning of participant indicia and the disposition of the station markers.

In the more complicated designations of stations by red and blue Roman numerals, these are described in the booklet of instructions by diagrams and it is recommended that these diagrams be displayed alongside the DISC for the convenience of the participants.

The invention having fully been described, it will be apparent to one of ordinary skill in the theory of scheduling that many changes and modifications can be made thereto without departing from the spirit of the invention as set forth herein.

What is claimed as new and intended to be covered by the letters patent is:

1. A composite digital scheduling slide rule comprising a rectangular master board with a central slot in which a plurality of slides may be inserted; each side may be set in the slot in a discrete number of admissible settings; in each face of said master board a plurality of rectangular viewing means and one circular viewing means; on each slide a scale of participant indicia and a scale of control indicia; rectangular viewing means in face of said master board and scales of participant indicia so placed that insertion of a slide in said slot in said master board effects a juxtaposition of the scale of participant indicia visible in a rectangular viewing means and the scale of station indicia flanking said rectangular viewing means; on said slide a scale of control indicia so placed that exactly one control indicium is visible in said circular viewing means in face of master board for each admissible setting and no control indicium is visible otherwise; for each admissible setting of said slide in said master board, each participant indicium is juxtaposed to exactly one station indicium, thus assigning said participant to the station to which the juxtaposed station indicium refers; movement of said slide from the initial admissible setting to a new admissible setting computes the new subschedule by graphical addition of lengths.

2. A composite digital scheduling slide rule described in claim 1, wherein said side is rectangular with two scales of participant indicia and two scales of control indicia; said slide may be inserted in said slot in master board in two ways; each insertion of said slide in said slot effects, said juxtaposition of a scale of participant indicia visible in a rectangular viewing means in said face of said master board and a scale of station indicia flanking said rectangular viewing means; scale of control indicia corresponding to said scale of participant indicia so placed that exactly one control indicium is visible in circular viewing means in face of said master board for each admissible setting of said slide in said slot and no control indicium is visible otherwise; each said admissible setting of slide assigns each participant to exactly one station.

3. A composite digital scheduling slide rule as in claim 2, wherein said rectangular viewing means are horizontal; said scales of participant indicia are horizontal such that exactly one scale of participant indicia is visible in a rectangular viewing means for each insertion of said slide in said slot in master board.

4. A composite digital scheduling slide rule as in claim 1, wherein said participant indicia are identified with the participant indicia; the initial admissible setting of a slide in the slot in said master board gives a subschedule which satisfies a condition of symmetrically repeated differences in the modular arithmetic performed by movement of said slide from one admissible setting to a second admissible setting.

* * * * *